United States Patent [19]

Hacknauer et al.

[11] Patent Number: 4,899,690

[45] Date of Patent: Feb. 13, 1990

[54] CONTAINER FOR ELECTROSTATOGRAPHIC TONER OR DEVELOPER

[75] Inventors: Frank Hacknauer, Honeoye Falls; Kenneth D. Corby, Rochester, both of N.Y.

[73] Assignee: Eastman Kodak Company, Rochester, N.Y.

[21] Appl. No.: 232,062

[22] Filed: Aug. 15, 1988

[51] Int. Cl.[4] ..... G03G 15/06

[52] U.S. Cl. ..... 118/653; 118/652; 355/260; 355/298

[58] Field of Search ..... 222/DIG. 1, 288, 406, 222/407, 414; 355/3 DD, 14 D, 15; 220/346, 348, 1 R; 118/652, 653, 657, 658

[56] References Cited

U.S. PATENT DOCUMENTS

| | | | |
|---|---|---|---|
| 3,999,654 | 12/1976 | Pollack | 222/DIG. 1 X |
| 4,271,784 | 6/1981 | Ishimoto et al. | 118/652 |
| 4,439,034 | 3/1984 | Daniels | 355/14 D X |
| 4,523,834 | 6/1985 | Pelda et al. | 355/14 D X |
| 4,565,435 | 1/1986 | Hart | 355/3 DD |
| 4,625,895 | 12/1986 | Tsukano | 222/DIG. 1 X |

FOREIGN PATENT DOCUMENTS

| | | | |
|---|---|---|---|
| 0049366 | 3/1985 | Japan | 355/3 DD |
| 0098467 | 6/1985 | Japan | 355/3 DD |

*Primary Examiner*—Arthur T. Grimley
*Assistant Examiner*—Robert Beatty
*Attorney, Agent, or Firm*—Leonard W. Treash

[57] ABSTRACT

A two-compartment container for supplying toner to an electrostatographic development station has a first compartment for containing and supplying fresh toner or toner mixed with carrier to the station and a second compartment for receiving and containing spent developer for disposal. When the container is mounted in a toner supplying position with respect to a development station, an opening in the second compartment mates with an opening in the station through which developer overflows. A door covering the opening to the second compartment is automatically openable by appropriate means associated with the station in response to placing the container in the toner supplying position.

8 Claims, 3 Drawing Sheets

CONTAINER FOR ELECTROSTATOGRAPHIC TONER OR DEVELOPER

TECHNICAL FIELD

This invention relates generally to electrostatography, and more particularly, to a container for toner or developer usable in a developing station, which station is of the type using a two-component developer.

BACKGROUND ART

U.S. Pat. No. 4,614,165 granted Sept. 30, 1986 to Folkins et al, is representative of a number of disclosures addressing the problem of the useful life of two-component electrostatographic developers. Two-component developers include finely divided toner particles that are to be deposited on the electrostatic image and carrier particles which may be magnetic. The carrier particles triboelectrically charge the toner particles and also help transport them through a development station. After substantial use, the carrier particles lose their ability to impart the correct charge to the toner particles due to formation of a scum on the carrier particles from mixing with toner and other reasons. They are replaced periodically in most machines.

U.S. Pat. No. 4,614,165 describes a number of methods and apparatus, known per se, that continuously replace the carrier particles. It suggests replacing used toner by supplying to the developing station a mixture of 25% carrier and 75% toner particles by weight. This mixture is added to a developer sump in the station that may be operating with a mixture of 96% carrier and 4% toner particles by weight. The added carrier particles cause the developer in the station to overflow into a separate container that can be emptied by the serviceman.

The above reference and the references discussed therein involve fairly elaborate mechanisms for mixing toner and carrier in the apparatus itself and generally require a serviceman to dispose of the spent developer that overflows.

DISCLOSURE OF THE INVENTION

It is the object of this invention to provide a toner container which facilitates the replacement of developer in a development station generally of this type.

This and other objects are accomplished by a two-compartment container for supplying toner or a mixture of toner and carrier to a development station. The development station has means for receiving the container in a toner supplying position and has an egress for spent developer. The container has means cooperable with the station for positioning the container in a toner suplying position. The container includes a first compartment for containing fresh toner and a second compartment having an ingress mateable with the spent developer egress on the receiving station through which ingress and egress spent developer can overflow into the second compartment.

With this structure, the two-compartment container is placed in a toner supplying position at the station. Spent developer automatically flows into the second compartment while toner and carrier are supplied from the first compartment to the station. When the first compartment is empty, the container is replaced and disposed of, automatically disposing of the spent developer. With this structure, the spent developer can be readily disposed of by an operator and does not require attention of a service person.

According to a preferred embodiment, the ingress for spent developer to the second compartment is coverable by a door which is in a normally closed position, but which is openable in response to positioning of the container in its toner supplying position.

BRIEF DESCRIPTION OF THE DRAWINGS

In the detailed description of the preferred embodiment of the invention presented below reference is made to the accompanying drawings, in which.

BEST MODE OF CARRYING OUT THE INVENTION

Figure 1:
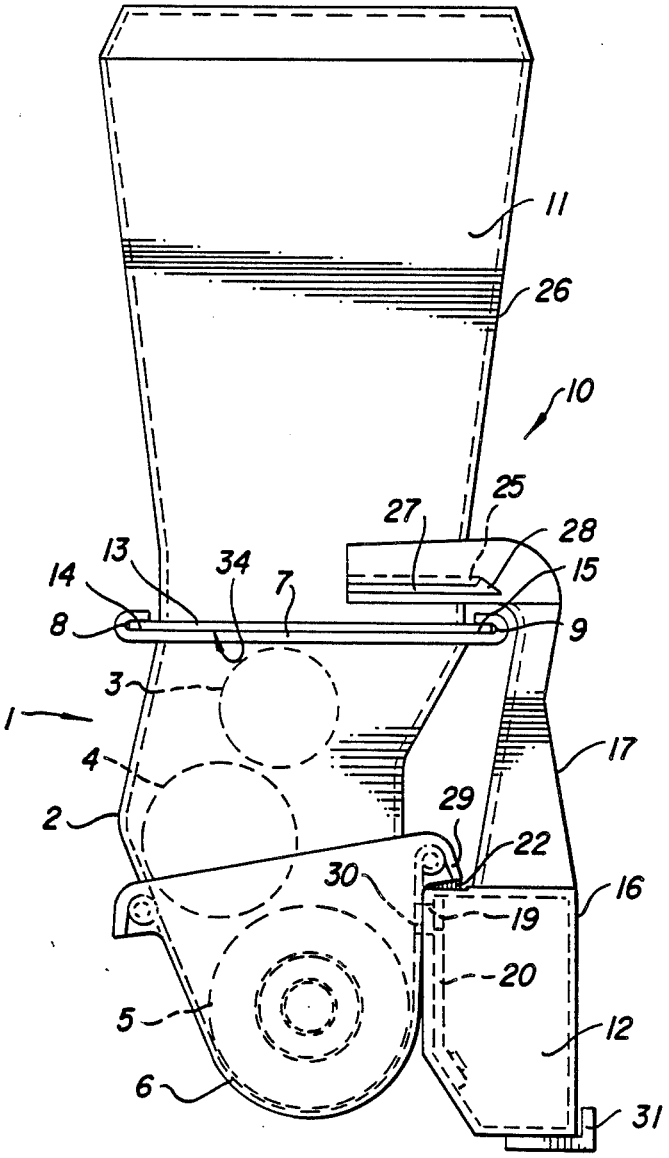
FIGS. 1 and 3 are an end view and perspective view respectively, with parts eliminated for clarity, of a development station with a container constructed according to the invention in its toner supplying position.
Figure 2:
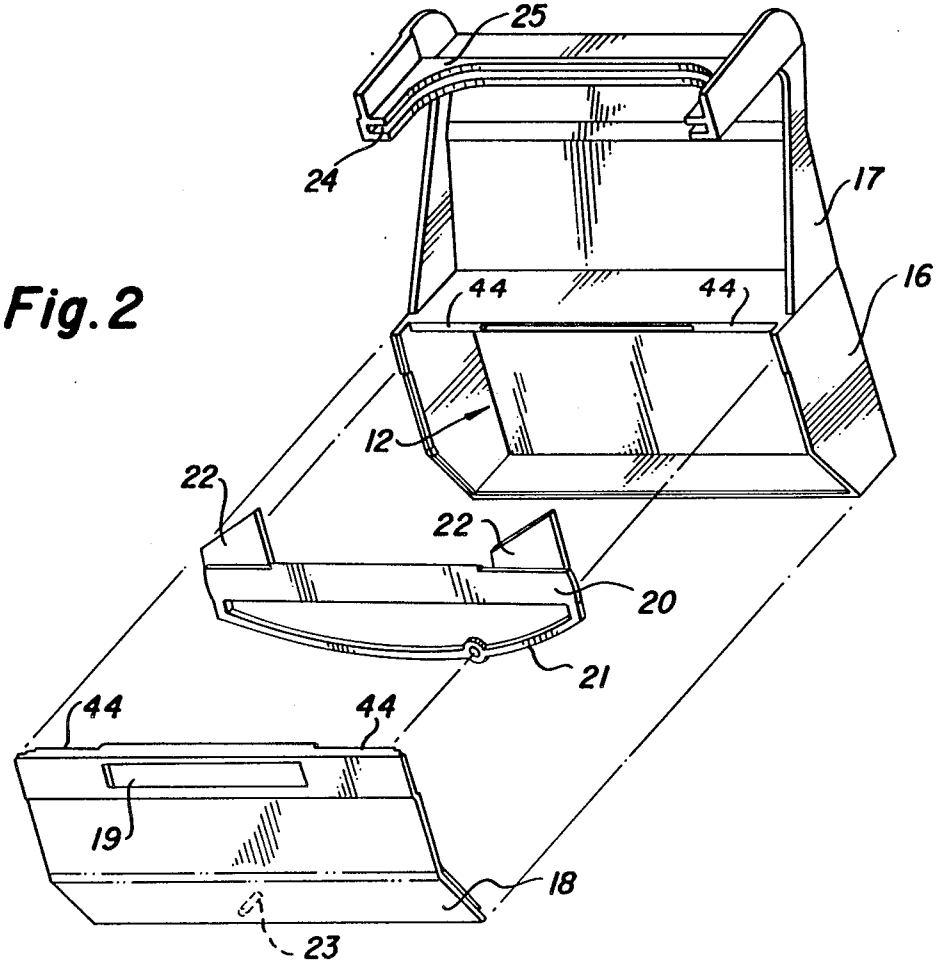
FIG. 2 is an exploded perspective view of a portion of the container shown in FIG. 1 that defines a compartment for receiving spent developer.
Figure 3:
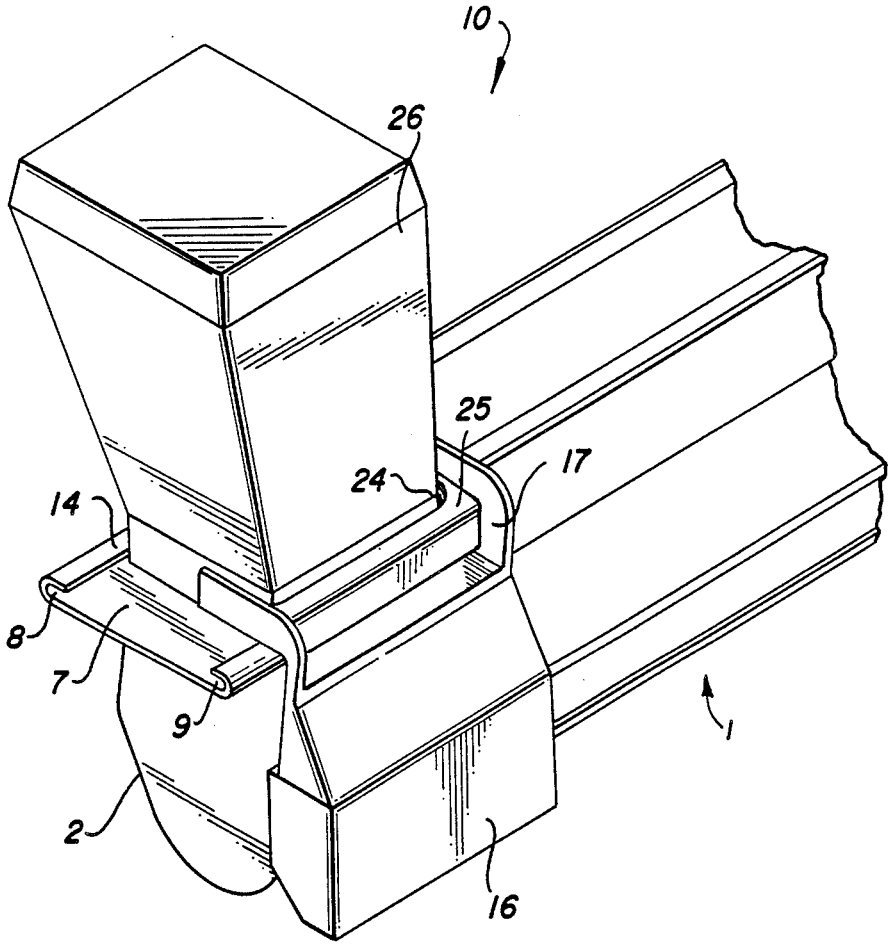

According to FIGS. 1–3, a developing station 1 is of the magnetic brush type including a housing 2, an application roller 3, a supply roller 4 and a mixing device 5, which may be, for example, a ribbon blender, all of which is well known in the art. Developer, comprising a mixture of, for example, 90–98% carrier particles and 2–10% toner particles by weight, is continually mixed by mixing device 5 in a sump 6 defined by housing 2. Preferably, the carrier particles are either permanent magnets or are magnetizable and can be transported within the station magnetically. Such mixing in sump 6 imparts an appropriate charge to the toner particles. The mixture (developer) is transported by supply roller 4 from sump 6 to application roller 3 which in turn transports the developer into toning relation with an electrostatic image carried on an electrophotographic member (not shown), all as is well known in the art.

A two-compartment container 10 has a first compartment 11 and a second compartment 12. The first compartment 11 is defined by an upper container portion 26 and is conventional in nature. It has side walls that are flared to permit the bottom of the chamber to mate with the developing station but still hold a substantial quantity of toner. A bottom wall 13 to upper container portion 26 includes flanges 14 and 15 and is partially or entirely openable by removal of a paper covering 34. The developing station 1 includes a slide 7 with curled edges forming groves 8 and 9 which receive flanges 14 and 15. This type of openable toner container is well known in the art, see, for example, U.S. Pat. No. 4,062,385 granted Dec. 13, 1977 to Katusha et al which patent is incorporated herein by reference.

The second compartment 12 is defined by a lower container portion 16 and is attached to the rest of the container by an arm 17. The lower container portion 16 and arm 17 are best seen in exploded perspective in FIG. 2. According to FIG. 2, the lower container portion 16 includes a cover 18 which has an ingress 19, for receiving spent toner into the second compartment 12. The ingress 19 is normally closed by a door 20 which includes a spring 21 and fingers 22. The door 20 is held against cover 18 by a pin 23 and the sides of a pair of openings 44 for the fingers 22.

Arm 17 extends generally upward from the lower container portion 16. At the top of arm 17 is an attachment structure including a groove 24 defined in part by a rail 25. The lower container portion 16 is attachable to the upper container portion 26 by the mating of groove 24 and rail 25 with a latch 27 on the upper container portion 26 (See FIG. 1).

The upper and lower container portions can be supplied to the operator together or separately depending upon convenience of packaging. The two container portions 16 and 26 are attached together for insertion in the apparatus. Such attachment is accomplished by sliding groove 24 over latch 27 until a hook portion 28 of latch 7 secures behind rail 25. The bottom wall 13 of the upper container portion 26 is placed on slide 7 with flanges 14 and 15 in grooves 8 and 9 and slid into place over housing 2 which leads down into sump 6. The paper covering 34 on bottom wall 13 can be opened automatically in this process as is well known in the art; see, for example, U.S. Pat. No. 4,062,385 cited above.

As the first compartment 11 is slid into its toner supplying position, the lower container portion 16 and the second compartment 12 also slides with it. Such sliding movement causes fingers 22 to engage a protrusion 29 on the development station 1, camming the fingers downward and opening the door 20 providing access to second compartment 12. An egress 30 in the housing 2 of the station 1 is positioned to mate with the ingress 19.

Preferably, first compartment 11 contains a mixture of toner and carrier. If a mixture of toner and carrier is gradually supplied from the first compartment 11 to the sump 6 through housing 2, some spent developer must overflow through egress 30 and into second compartment 12, thereby gradually replacing the spent developer in the developing station 1.

After the first compartment 11 is empty, container 10 is slid out of its toner supplying position with flanges 14 and 15 leaving grooves 8 and 9. This movement can be used to replace the paper covering over the opening in the bottom 7. This movement removes the fingers 22 from engagement with protrusion 29, and spring 21 then pushes the door 20 back to its closed position across ingress 19. Thus, the now at least partially fully second compartment is closed and the spent developer therein will not soil the person or clothing of the operator disposing of container 10.

The two-compartment container 10 has many advantages. Inclusion of a small amount of carrier with the toner, for example, 10% carrier with 90% toner by weight, helps break up the toner and prevent agglomeration during travel and storage. A continuous replacement of a small amount of spent developer reduces the need for complete replacement of the developer, a task commonly performed by a serviceman. The continuous replacement of spent developer causes the parameters of the system to be more consistent over time than if the developer is replaced periodically. The automatic and clean removal of the spent developer with the toner container, permits easy disposal of the spent developer by the operator without soiling person or clothing.

A primary advantage of the invention lies in the convenience associated with a single container that both supplies toner and removes spent developer. However, the automatic compartment closing feature of the door 20 is a convenience feature that could be used separate from the features of the first compartment. U.S. Pat. No. 4,614,165, mentioned above, shows an open top waste container for receiving spent developer. Disposing of its contents without soiling the operator would be difficult. A container comparable to the lower container portion 16, with or without arm 17, that is completely closed when not in its operative position on the station, provides a substantial convenience to the operator, compared to the waste container shown in the prior art. If the lower container portion is not connected to the upper container portion 26, the developing station would require suitable structure for receiving the container and holding it in its operative position. Supporting structure 31 shown in FIG. 1 is illustrative of structure that would be adequate to guide the container into place with a movement that would necessarily open the door 20, and hold the ingress 19 in a mating relationship with egress 20.

The invention has been described in detail with particular reference to a preferred embodiment thereof, but it will be understood that variations and modifications can be effected within the spirit and scope of the invention as described hereinabove and as defined in the appended claims.

I claim:

1. A two-compartment container for supplying toner to an electrostatographic developing station of the type using a developer which is a mixture of toner particles and carrier particles and which station has means for receiving the container in a toner supplying position and has an egress for spent developer, said container having means cooperable with such a receiving means for positioning said container in a toner supplying position;

a first compartment for containing at least fresh toner; and a second compartment having an ingress mateable with a spent developer egress of a developing station for receiving spent developer therethrough when said container is in its toner supplying position.

2. A two-compartment container according to claim 1 further including a door movable between positions closing and opening said ingress.

3. A two-compartment container according to claim 2 further including means cooperable with said station for moving said door from its closing position to its opening position in response to placement of said container in its toner supplying position.

4. A two-compartment container according to claim 1 wherein said first compartment is defined by an upper container portion, said positioning means is located at a bottom wall of said upper container portion when said container is in its toner supplying position, and said second compartment is positioned below said positioning means when said container is in its toner supplying position.

5. A two-compartment container according to claim 4 wherein said bottom wall is covered by a removable cover and said positioning means includes at least two flanges associated with said bottom wall, which flanges are shaped to slidingly mate with grooves in said station to position said container, and said container further includes a door movable from a position closing, said ingress to a position opening said ingress in response to moving of said container to its toner supplying position.

6. A container for spent developer usable with an electrostatographic developing station having means for receiving such a container and an egress for spent developer, said container including a compartment for receiving spent developer, said compartment having an ingress mateable with an egress of a station in which said container is received, a door movable between positions closing and opening said ingress, and means cooperable with said station for moving said door from its closing position to its opening position in response to positioning said ingress in mating relationship with the egress of a receiving station.

7. A container according to claim 6 including means for attaching said container to a toner supplying container for unitary mounting with respect to said station.

8. A container according to claim 6 wherein said means for moving said door includes at least one finger connected to said door and projecting from said container, said finger having a cam surface engageable with said station to cam said door to an open position and said container further includes resilient means urging said door toward a closed position.

* * * * *